US005392718A

United States Patent [19]

Stevens

[11] Patent Number: 5,392,718

[45] Date of Patent: Feb. 28, 1995

[54] WHEEL LIFTING ASSEMBLY FOR MOBILE FOLDING STAGE UNIT

[75] Inventor: Kenneth V. Stevens, Brooklyn, N.Y.

[73] Assignee: King Arthur Co., div. of Shelby Williams Industries, Inc., Statesville, N.C.

[21] Appl. No.: 971,305

[22] Filed: Nov. 4, 1992

[51] Int. Cl.[6] ..... A47B 3/00

[52] U.S. Cl. ..... 108/167; 52/7; 248/188; 108/179

[58] Field of Search ..... 52/7, 69; 108/112, 113; 248/188

[56] References Cited

U.S. PATENT DOCUMENTS

| | | | |
|---|---|---|---|
| 2,978,754 | 4/1961 | Wilson | 108/112 |
| 3,086,256 | 4/1963 | Schieber | 108/112 |
| 3,245,363 | 4/1966 | Author, Jr. et al. | 108/113 |
| 3,337,262 | 8/1967 | Katzfey et al. | 108/113 X |
| 3,351,029 | 11/1967 | Bue | 108/112 |
| 3,715,143 | 2/1973 | Gerken et al. | 108/113 X |
| 4,026,221 | 5/1977 | Wilson et al. | 108/113 |
| 4,054,096 | 10/1977 | Wilson et al. | 108/113 |
| 4,089,522 | 5/1978 | Rock | 108/112 X |
| 4,133,271 | 1/1979 | Carlson | 108/113 |
| 4,327,650 | 5/1982 | Bue | 108/113 |
| 4,615,278 | 10/1986 | Cabrelli | 248/188 X |
| 4,662,591 | 5/1987 | Encontre | 248/188 |
| 4,852,837 | 8/1989 | Merten et al. | 248/188 |
| 4,949,649 | 8/1990 | Terres | 108/116 |
| 4,989,519 | 2/1991 | Welsch et al. | 248/188 X |
| 5,127,647 | 7/1992 | Wilkinson | 248/188 X |

FOREIGN PATENT DOCUMENTS

| | | | |
|---|---|---|---|
| 562203 | 8/1958 | Canada | 108/112 |
| 9108693 | 6/1991 | WIPO | 108/112 |
| 9303240 | 2/1993 | WIPO | 52/7 |

OTHER PUBLICATIONS

StageRight, "Portable Staging", 1989, USA.
SICO, "Mobile Folding STages", 1986, USA.
SICO, "Mobile Folding Stages, Series 1800", May, 1983, USA.

*Primary Examiner*—Peter M. Cuomo
*Assistant Examiner*—Suzanne L. Dino
*Attorney, Agent, or Firm*—Ostrager, Chong & Flaherty

[57] ABSTRACT

A mobile folding stage unit has right and left platform sections pivotably mounted in side-by-side relation to a frame, corresponding sets of roller wheels mounted to the frame, pivot brackets mounted to the bottom of the platform sections, support brackets mounted to the frame to which the platform sections are pivotably mounted via the pivot brackets, and pivot legs pivotably mounted to an eccentric position on the corresponding pivot brackets and slidable in pivotable bearing guides mounted to the frame adjacent the corresponding roller wheels. When the platform sections are folded to the vertical position for storage, the pivot legs are lifted above the wheels, and when they are opened to the horizontal position for use, the pivot legs are lowered to lift the wheels out of contact with the ground. Other features include outboard legs with telescoping leg sections, inner extension legs, stabilizer bars which have an over-center locking function for storage, and an improved construction for the bearing guides.

15 Claims, 9 Drawing Sheets

WHEEL LIFTING ASSEMBLY FOR MOBILE FOLDING STAGE UNIT

FIELD OF THE INVENTION

This invention generally relates to a mobile folding stage unit, and particularly to a wheel lifting assembly for shifting the stage unit between use and storage modes.

BACKGROUND ART

Mobile folding stage units are used for setting up temporary staging in multi-use spaces, such as auditoriums, convention halls and meeting rooms. A typical mobile folding stage unit has a pair of platform sections pivotably mounted on a frame which are folded to parallel, upright positions for convenient storage and opened to a horizontal position on fold-out legs for staging use. The unit frame typically has roller wheels to allow the unit to be wheeled away for storage. In general, conventional units provide some mechanism for retracting the roller wheels when the platform sections are opened to the horizontal position for use.

For example, a conventional mobile folding stage unit is illustrated in FIG. 6 having a pair of stage surface members 101 supported on main support legs 102 which are braced by pivotable lower cross braces 103 and upper cross braces 104 and 105. Wheels 106 are mounted to a wheel retracting assembly pivotably mounted to the lower ends of the main support legs 102. When the stage unit is to be opened and located in a fixed position, the installer pulls a release pin (not shown) and rotates the wheels 106 to an upward position above the ends of the support legs 102 using the handles 107. The support legs also have telescoping leg sections 108 for elevating the stage surface to higher height levels. The wheel retracting mechanism for this type of stage unit assembly has the problem that manual releasing and re-locking actions are required of the installer when the unit is to be shifted between use and storage.

Another type of conventional mobile folding stage unit is illustrated in FIGS. 7A and 7B having a pair of platform members 111*a*, 111*b* pivotably supported on a lower frame 112. Wheels 113 are mounted to the ends of cross braces 114*a*, 114*b* for inwardly pivoting movement. The cross braces are pivotably mounted at one end to the frame 112 at the pivot points 115*a*, 115*b* and on the opposite end to the fold-down outer legs 116*a*, 116*b*. When the folded unit shown in FIG. 7A has been wheeled to its intended position, the platform sections 111*a*, 111*b* are opened outwardly to the horizontal position, and the follower movement of the attached cross braces 114*a*, 114*b* causes the wheels 113 to be rotated above the lower bar 112*a* of the frame 112, thereby retracting them out of the way. However, this type of wheel retraction mechanism requires a relatively expensive frame structure and pivot mountings for the cross braces and wheels. The pivot mountings 115*a*, 115*b* for the cross braces must be tight enough to ensure that the stage does not sway under weight, yet loose enough to allow folding of the platform sections for storage.

A further type of conventional mobile folding stage unit is illustrated in FIGS. 8A and 8B having a pair of platform members 121 pivotably supported on an upper frame 130 to which main support legs 131 are rigidly connected by cross brace 122. Linkage bars 123 are connected between the pivoting ends 121*a* of the platform members 121 and the pivotable holder bars 124 (at pivot points 126). The wheels 125 are mounted to plates 128 connected to the holder bars 124 for outwardly pivoting movement. When the stage unit is folded with the platform members 121 in vertical positions, the linkage bars 123 pivot the outer ends of the holder bars 124 downward so that the wheels 125 make contact with the ground below the ends 129 of the main support bars 131. As the platform members 121 are opened to the horizontal position, the downward pivoting movement of their inner ends causes the linkage bars 123 to lift the outer ends of the holder bars 124 and wheels 125 to a height above the ends 129 of the support bars 131, so that the wheels become retracted out of the way. However, this type of wheel retraction mechanism has a relatively complex and costly structure for the frame, linkage bars, and holder bars, and is rather difficult to assemble.

SUMMARY OF THE INVENTION

In accordance with the present invention, a mobile folding stage unit comprises: a pair of platform sections having inner ends thereof pivotably mounted in side-by-side relation to a frame for pivotally folding the platform sections to vertical positions for storage and opening the platform sections to horizontal positions for staging use; two sets of roller wheels, wherein each set comprises a pair of roller wheels fixedly mounted to a lower part of the frame on a respective side of the frame to which a corresponding one of the platform sections is mounted; two sets of pivot brackets, wherein each set comprises a pair of pivot brackets fixedly mounted to a bottom surface at the inner end of a respective one of the platform sections adjacent respective ones of a corresponding set of roller wheels; two sets of support brackets, wherein each set comprises a pair of support brackets fixedly mounted to the frame adjacent respective ones of a corresponding set of roller wheels, and wherein the respective pivot brackets of the platform sections are pivotably mounted to the corresponding support brackets of the frame; two sets of pivot legs, wherein each set comprises a pair of pivot legs each of which has an upper end pivotably mounted to an eccentric position on a corresponding one of the pivot brackets and a given length between upper and lower ends thereof; and two sets of bearing guides, wherein each set comprises a pair of bearing guides each of which is pivotably mounted to a respective support bracket adjacent a corresponding one of the roller wheels and guides a corresponding one of the pivot legs in up and down movement, and wherein each said pivot leg has a selected length such that when the corresponding platform section is pivoted to the vertical position for storage, the upper end of the pivot leg is lifted by its eccentric position on the corresponding pivot bracket so that the lower end of the pivot leg is lifted above the contact point of the corresponding wheel with the ground, and when the corresponding platform section is pivoted to the horizontal position for staging use, the upper end of the pivot leg is lowered by its eccentric position on the corresponding pivot bracket so that the lower end of the pivot leg is lowered below the corresponding wheel so as to make contact with the ground. In the preferred embodiment, each platform section has a pair of fold-down outboard legs pivotably mounted at an outer end for supporting the outer end of the platform section during staging use.

Other features of the present invention include an improved bearing guide for a pivot leg of rectangular cross-section, wherein the bearing guide has a rectangular center bore defined by four inner walls each having a given length between upper and lower edges thereof, and four plastic guide elements for clipping onto respective ones of its inner walls. The bearing guide is pivotably mounted in a well of the support bracket fixedly mounted to the frame of the mobile folding stage unit. The support bracket has an integrally formed support member defined by an inner abutment wall and a pair of rounded abutment elements for holding fold-down inner extension legs for the mobile folding stage unit in a stable position.

A further feature of the present invention is the use of stabilizer bars for supporting the platform sections which are pivotably connected between a corresponding support bracket and an outboard leg for bracing the outboard leg during staging use. The stabilizer bar has an over-center locking function for locking the corresponding platform section in the vertical position for storage.

Other objects, features and advantages of the present invention will be apparent from the following detailed description of the preferred embodiments with reference to the drawings, of which:

DETAILED DESCRIPTION OF THE INVENTION

Referring to FIGS. 1A to 1D, a preferred embodiment of a mobile folding stage unit in accordance with the present invention is shown having right and left-side platform sections 10*a*, 10*b* pivotably mounted in side-by-side relation to a frame 11, right and left-side sets of roller wheels 12*a*, 12*b* mounted on respective sides of the frame 11 adjacent the inner ends of the corresponding platform sections 10*a*, 10*b*, right and left-side pivot brackets 13*a*, 13*b* fixedly mounted to a bottom part of the platform sections adjacent the corresponding roller wheels 12*a*, 12*b*, and right and left-side sets of pivot legs 14*a*, 14*b* (to be explained further herein).

The platform sections 10*a*, 10*b* are folded to vertical positions for storage, and opened to horizontal positions for staging use. The platform sections 10*a*, 10*b* are supported during use by right and left-side sets of fold-down outboard legs 15*a*, 15*b*. The sets of outboard legs 15*a*, 15*b* have respective upper cross braces 17*a*, 17*b*, and lower cross braces 18*a*, 18*b*. For increasing the height level of the platform sections during use, the outboard legs 15*a*, 15*b* have respective telescoping extension legs 16*a*, 16*b*, and fold-down inner extension legs 19*a*, 19*b* are provided. The platform sections 10*a*, 10*b* also have right and left-side sets of stabilizer bars 20*a*, 20*b* for bracing the respective outboard legs 15*a*, 15*b* (and for a locking function to be explained in further detail herein).

Figure 1A:
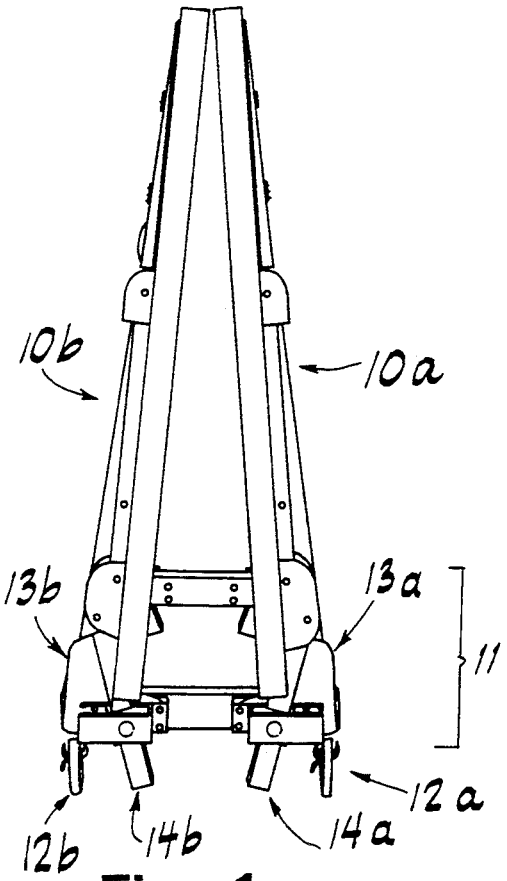
FIG. 1A illustrates a mobile folding stage unit in accordance with the present invention having its platform sections folded to the vertical position for storage.
Figure 1D:
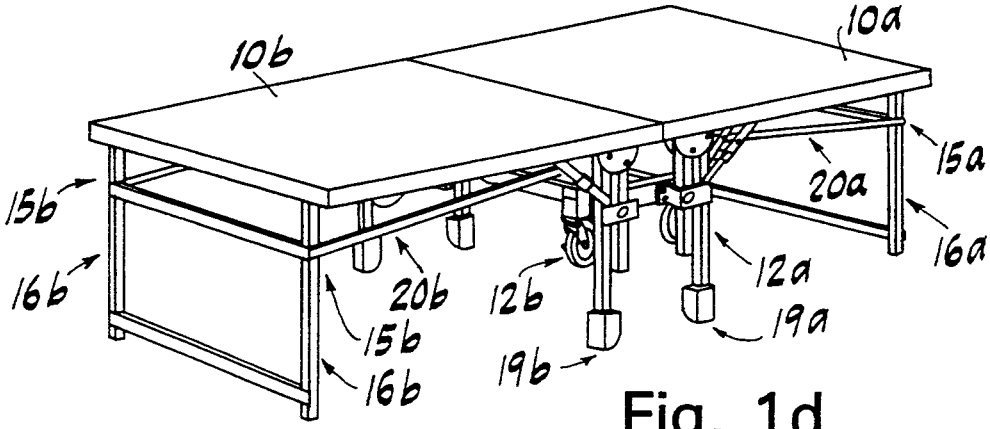
FIG. 1D shows the use of telescoping leg sections in the outboard legs of the stage unit to provide a higher height level for the stage unit.
Figure 1C:
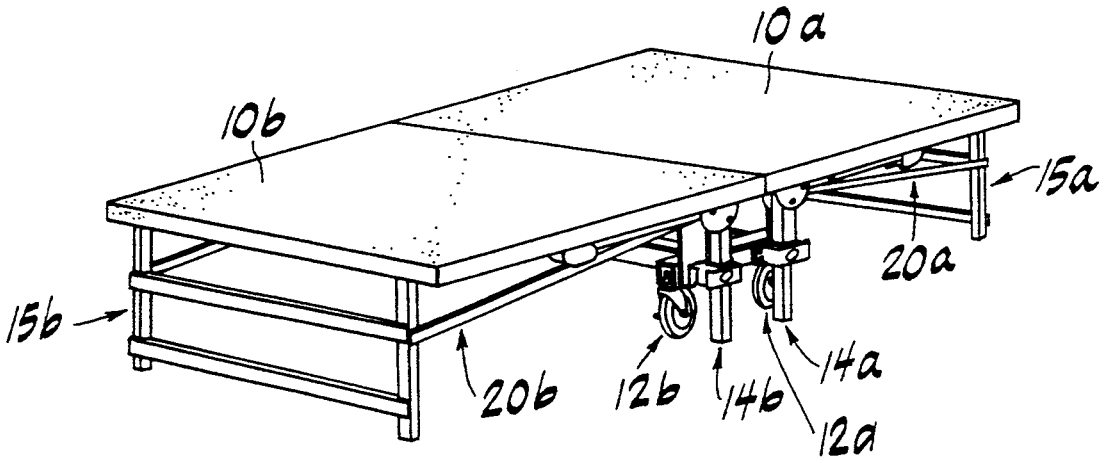
FIG. 1C shows both platform sections in the horizontal position for staging use.
Figure 1B:
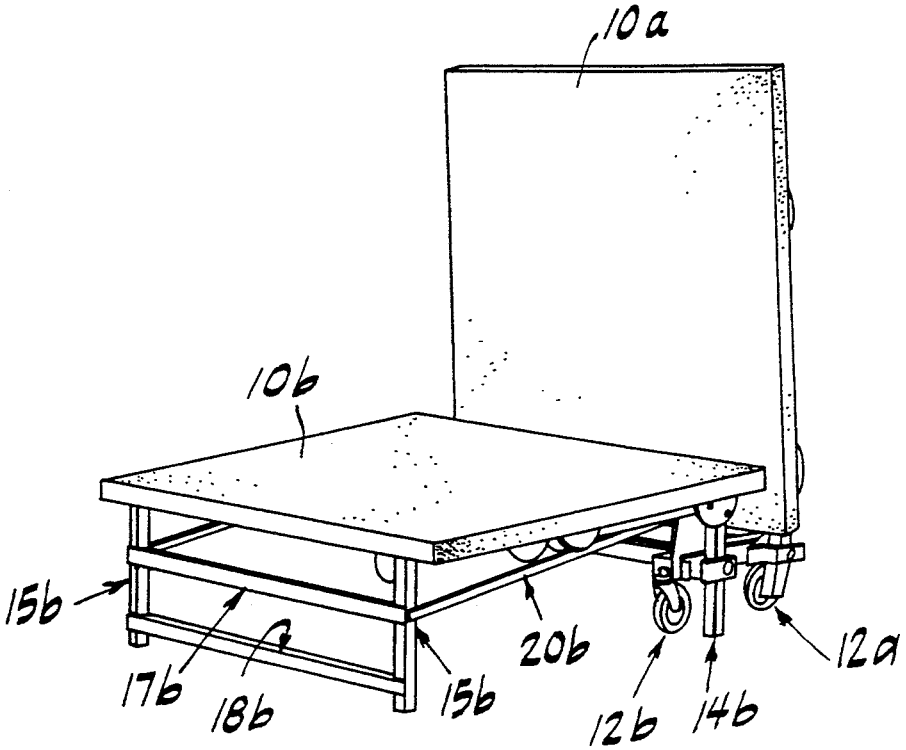
FIG. 1B shows the stage unit with one platform section opened to the horizontal position.

In FIG. 1A, the mobile folding stage unit has both platform sections 10*a*, 10*b* folded to vertical positions for storage. In FIG. 1B, the left-side platform section 10*b* is shown opened to the horizontal position with the left-side set of pivot legs 14*b* lifting the left-side set of wheels 14*b* out of contact with the ground. The set of outboard legs 15*b* is folded down and braced by stabilizer bars 20*b*. In FIG. 1C, both platform sections 10*a*, 10*b* are opened in the horizontal position for staging use, with the right and left-side sets of pivot legs 14*a*, 14*b* lifting the right and left-side sets of wheels 14*a*, 14*b* out of contact with the ground. In FIG. 1D, the platform sections 10*a*, 10*b* of the mobile stage unit are set at a higher height level using the telescoping leg sections 16*a*, 16*b* in the outboard legs 15*a*, 15*b* and the inner extension legs 19*a*, 19*b*.

Figure 2:
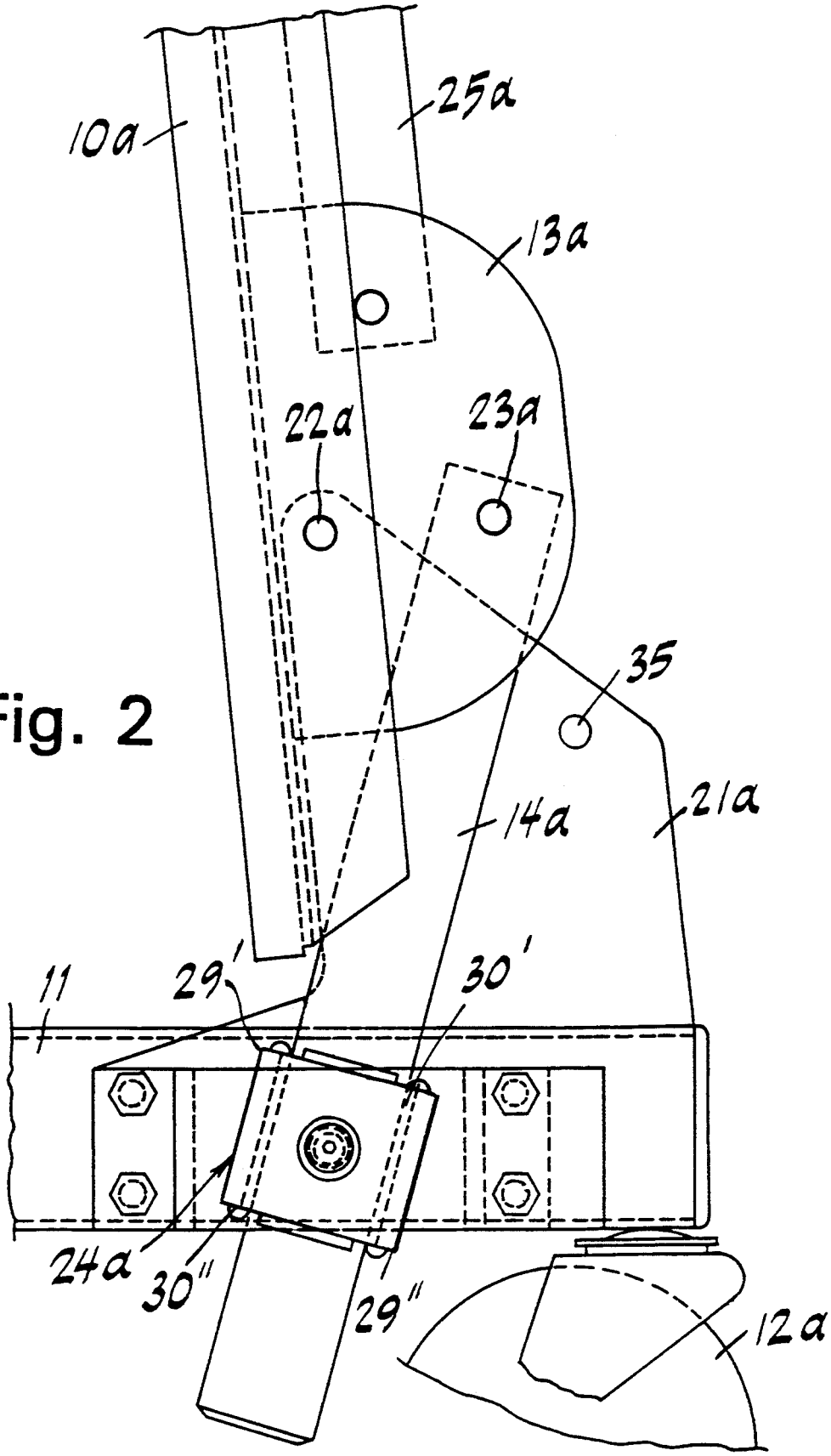
FIG. 2 is a side sectional view showing a right-side platform section, pivot bracket, and pivot leg in the vertical position for storage.

In FIG. 2, the right-side platform section is shown in detailed sectional view in the vertical position for storage. The platform section 10*a* has the pivot bracket 13*a* fixedly mounted to it. The frame 11 has a support bracket 21*a* and roller wheel 12*a* fixedly mounted to it. The support bracket 21*a* has an upright end with a pivot point. 22*a* formed therein. The platform section 10*a* is pivotably mounted to the support bracket 21*a* of the frame 11 by a pin mounting through the corresponding pivot point of the pivot bracket 13*a* and the pivot point 22*a* of the support bracket 21*a*. The pivot leg 14*a* has an upper end pivotably mounted to a pivot point 23*a* at an eccentric position on the pivot bracket 13*a*. The intermediate length of the pivot leg is slidably received in a bearing guide 24*a* which is pivotably mounted to a lower portion of the support bracket 21*a* adjacent the roller wheel 12*a*. A fold-down inner extension leg 25*a* is also shown pivotably mounted to the pivot bracket 13*a* for the platform section 10*a*. When the platform section 10*a* is folded to the vertical position for storage, the upper end of the pivot leg is lifted by its eccentric position 23*a* on the pivot bracket 13*a* so that the lower end of the pivot leg is lifted above the contact point of the roller wheel 12*a* with the ground. Thus, the stage unit can be wheeled away for storage. The platform section 10*a* is preferably pivoted past the vertical by a slight amount, e.g., about 5 degrees, so that it can be held stably upright by its over-center position. The upright portion of the support bracket 21*a* has a correspondingly angled edge to support the platform section 10*a* in its over-center position. The inner extension leg 25*a* can likewise be folded away against the platform section 10*a*.

Figure 3:
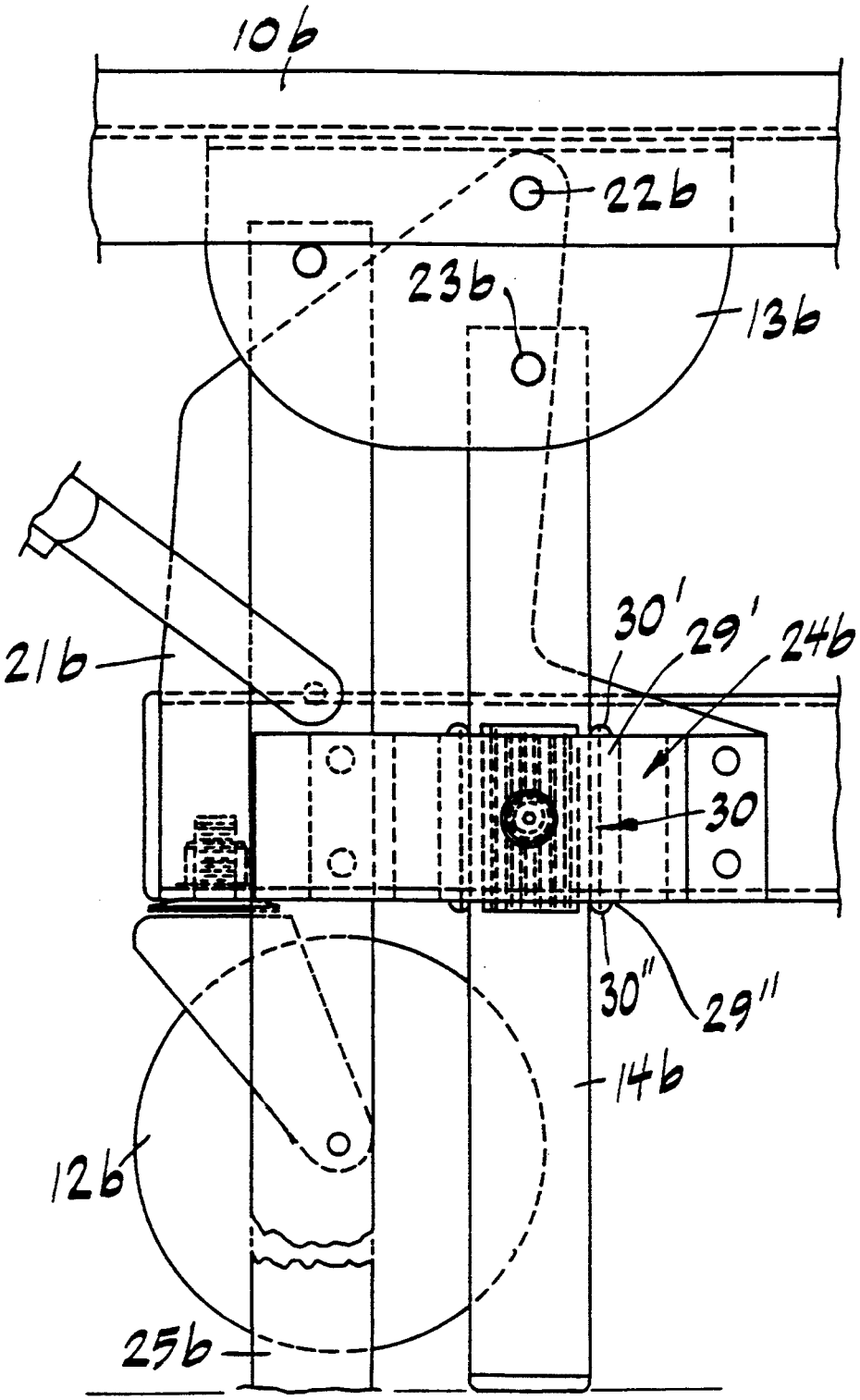
FIG. 3 is a side sectional view showing a left-side platform section, pivot bracket, and pivot leg in the horizontal position for staging use.

In FIG. 3, the left-side platform section 10*b* is shown in detailed sectional view in the horizontal position for staging use. When the platform section 10*b* is pivoted to the horizontal position, the upper end of the pivot leg 14*b* is lowered by its eccentric position 23*b* on the pivot bracket 13*b* so that the lower end of the pivot leg is lowered below the roller wheel 12*b* in order to lift the roller wheel 12*b* out of contact with the ground. The length of the pivot leg 14*b*, for example, may be sufficient to lift the wheel one-half inch out of contact with the ground, and hold the platform section 10*b* at a height of 16 inches above the ground. In order to lift the platform to a higher height, for example, 24, 30 or 32 inches, the inner extension legs 25*b* having the selected longer length are pivoted downward to support the inner end of the platform section, while the outboard legs 15*b*, with telescoping leg sections 16*b*, are used to support the outer end of the platform section.

Figure 4A:
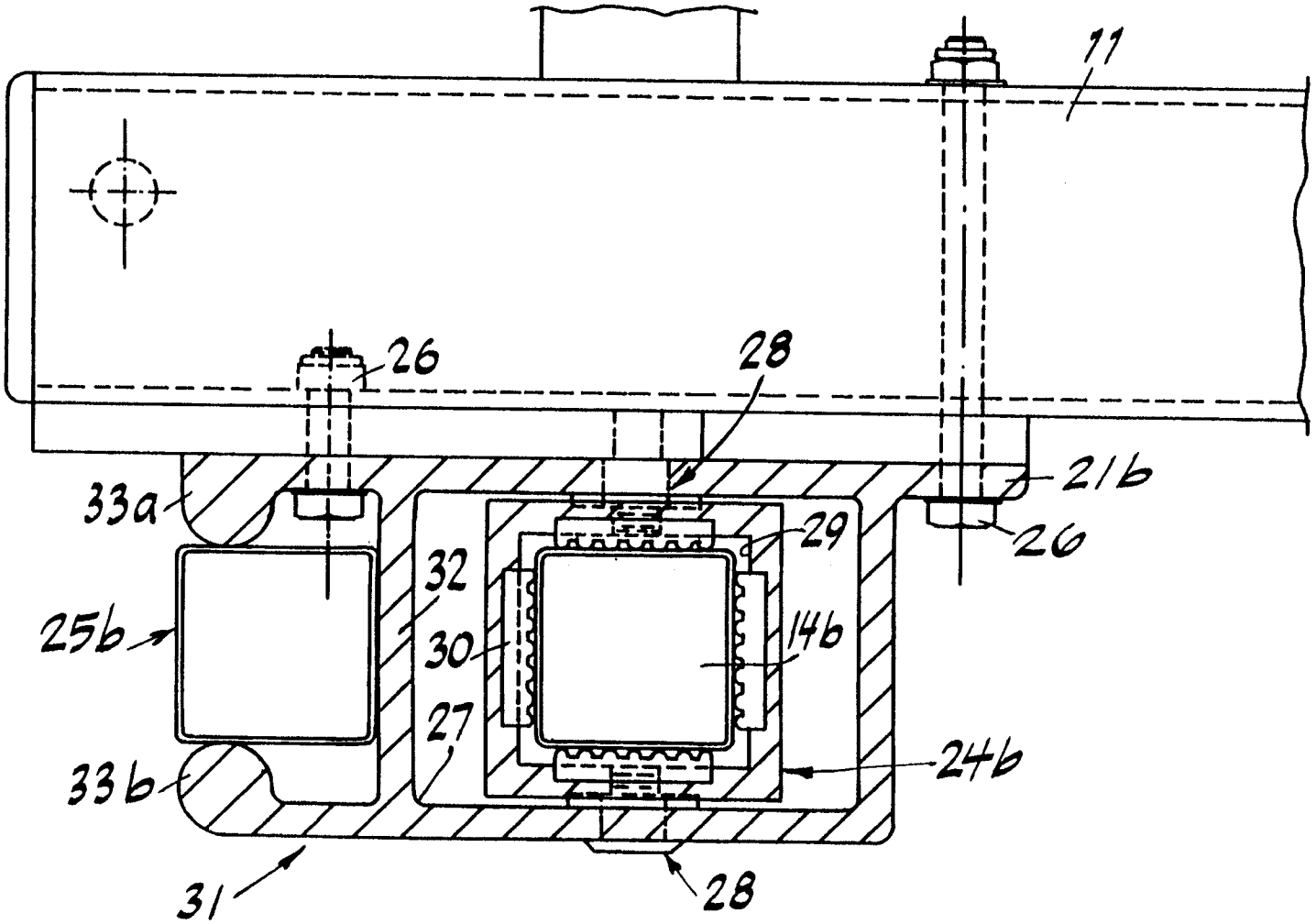
FIG. 4*a* is a plan sectional view and FIG. 4*b* is a perspective detailed view of the features in the invention of a pivotable bearing guide with clip-on guide elements, mounting bracket, and three-point abutment support member for an extension leg.
Figure 4B:
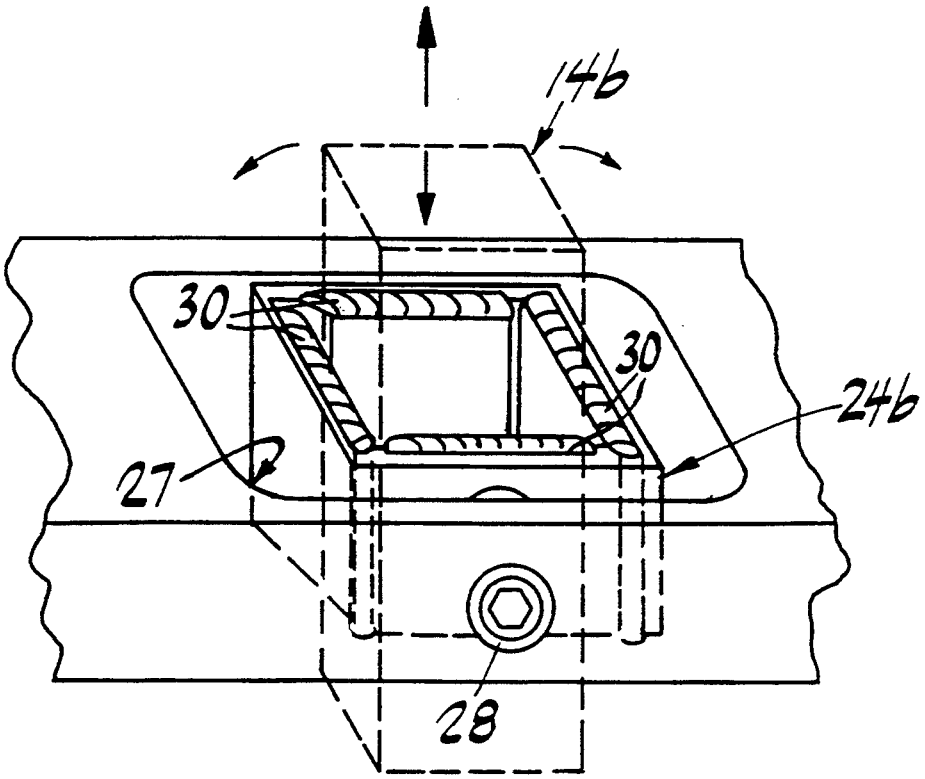

In FIG. 4, the support bracket and bearing guide are shown in detailed view. The support bracket is made of extruded metal, e.g., aluminum, for load bearing strength. The lower part of the support bracket is bolted to the frame 11 by bolts 26. The bearing guide 24*b* is pivotably held in a well 27 of the support bracket 21*b* by pivot bolts 28, in order to allow the bearing guide 24*b* to pivot with a follower motion as the pivot leg 14*b* is slidably raised or lowered therethrough.

In accordance with a feature of the present invention, the pivot leg has a rectangular cross-section and is received in a center bore of the bearing guide 24*b* having a matching cross-section. The bearing guide may be made of extruded aluminum also. The rectangular center bore of the bearing guide 24*b* is defined by four inner walls 29 each having a given length, e.g., 1.75 inches, between upper and lower edges 29' and 29" respectively Four plastic guide elements 30 are held in the center bore of the bearing guide 24*b*. The plastic guide element 30 is preferably made of a high-density plastic material, such as Delrin TM plastic, which has self-lubricating properties. The guide element 30 has a smooth inner surface for making contact with the pivot leg 14*b* slidably moved through the center bore of the bearing guide, an outer surface which is placed in contact against a corresponding inner wall, and a pair of retainer elements 30' and 30" spaced apart by the given length for clipping onto the upper and lower edges 29' and 29" of the corresponding inner wall. The guide elements can thus be conveniently installed in the bearing guide.

As a further feature of the invention, the support bracket 21*b* further has a support member 31 integrally formed at an end thereof facing toward the swing arc of the inner extension leg 25*b*. The support member consists of an inner abutment wall 32 and a pair of rounded abutment elements 33*a*, 33*b* that are spaced apart from each other by a width corresponding to the width of the inner extension leg 25*b*. When the inner extension leg is swung downward (for lifting the platform to a higher height level), it is positively guided into position by the rounded abutment elements 33*a*, 33*b*, and held in positional and lateral stability by the three-sided contact with the rounded abutment elements 33*a*, 33*b* and inner abutment wall 32.

Figure 5B:
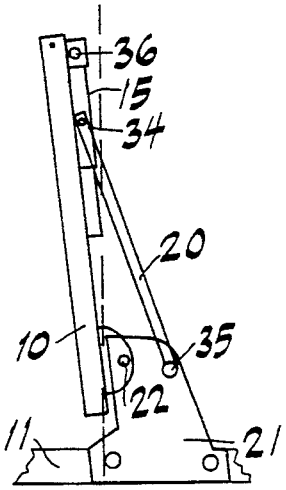
FIG. 5B shows the alignment of the parts in the locking position.
Figure 5A:
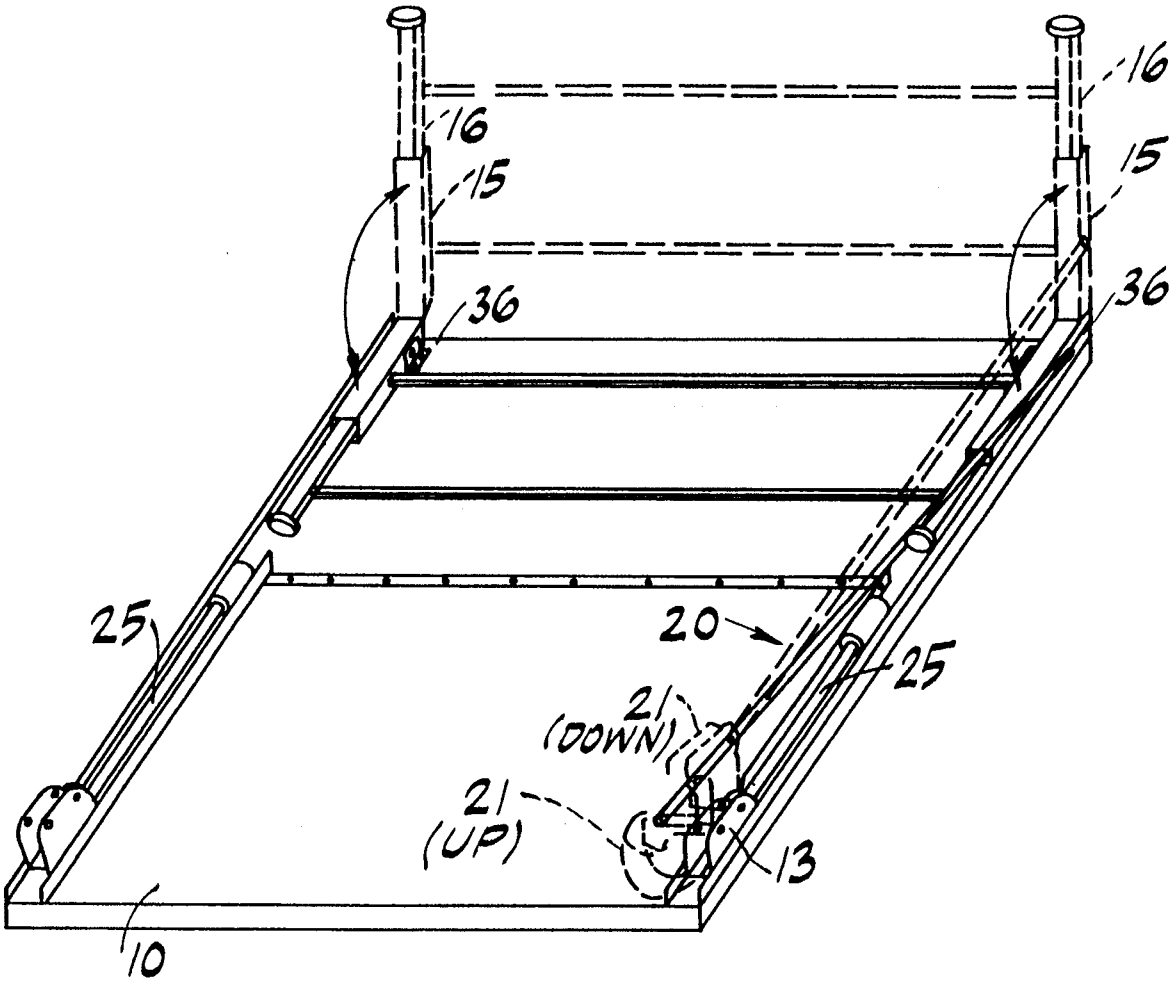
FIG. 5A is a view of the bottom side of a platform section showing a feature of the invention wherein stabilizer bars are arranged to perform the dual functions of bracing the outboard legs for staging use and locking the platform section in the vertical position for storage.
Figure 7A:
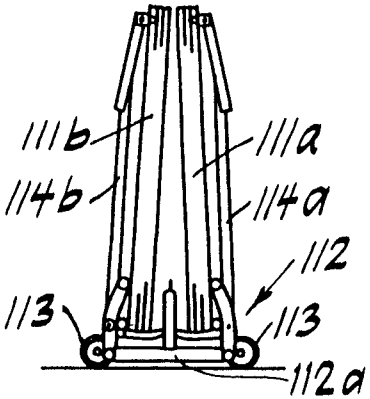
Fig. 7a (Prior Art)
FIGS. 7A and 7B illustrate another type of conventional mobile folding stage unit having an inwardly pivoting wheel assembly in accordance with the prior art.
Figure 7B:
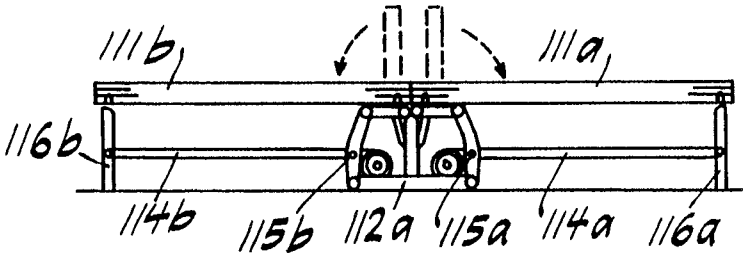
Fig. 7b (Prior Art)
Figure 6:
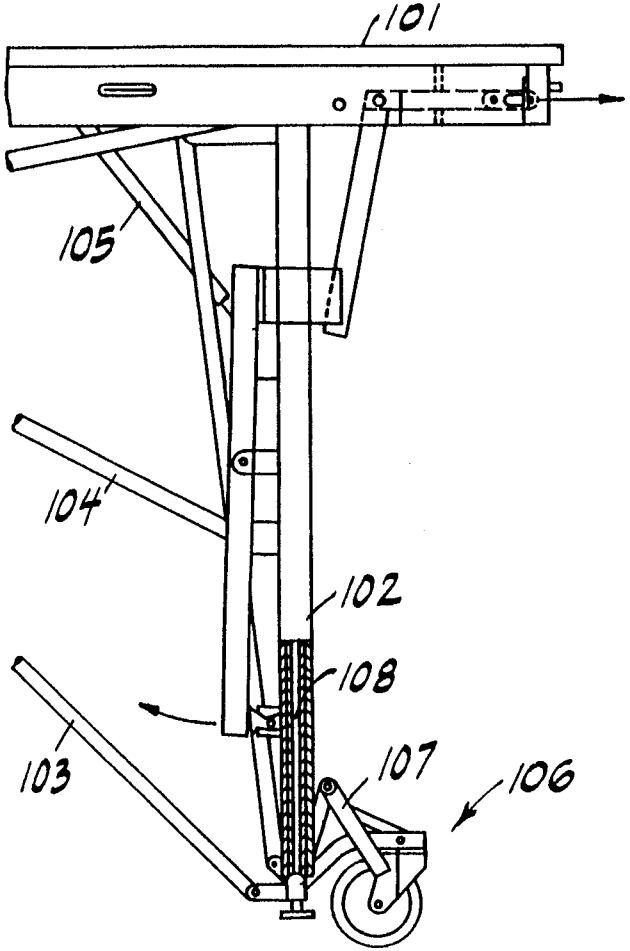
Fig. 6 (Prior Art)
FIG. 6 illustrates one type of conventional mobile folding stage unit having a retracting wheel assembly in accordance with the prior art.
Figure 8A:
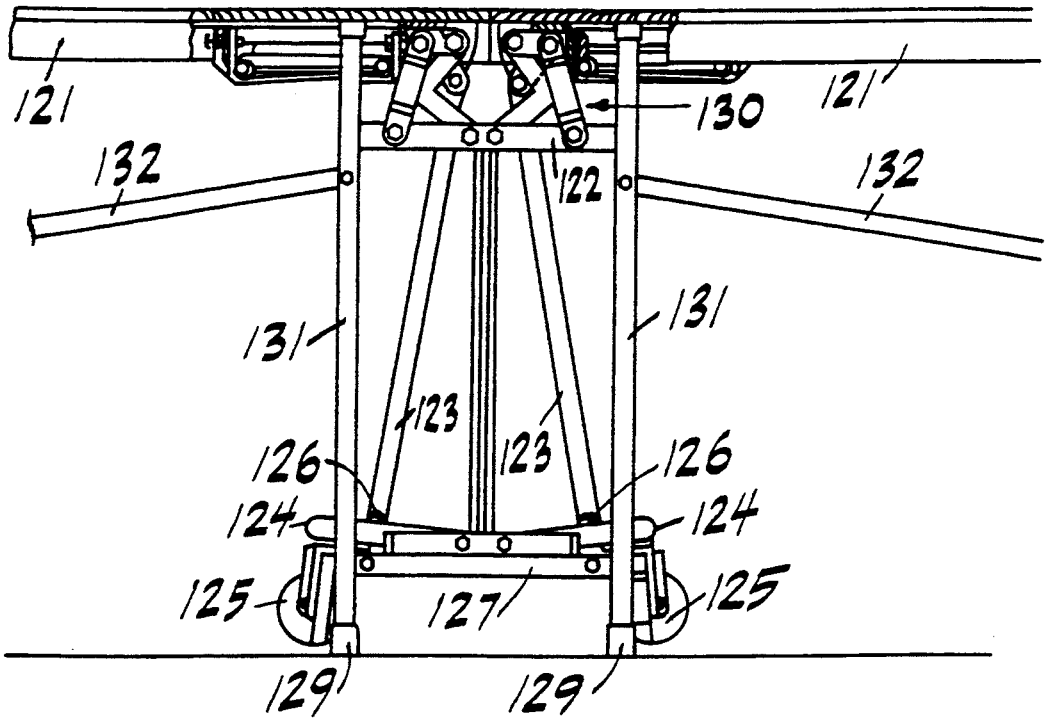
Fig. 8a (Prior Art)
FIGS. 8A and 8B illustrate a third type of conventional mobile folding stage unit having an outwardly pivoting wheel assembly in accordance with the prior art.
Figure 8B:
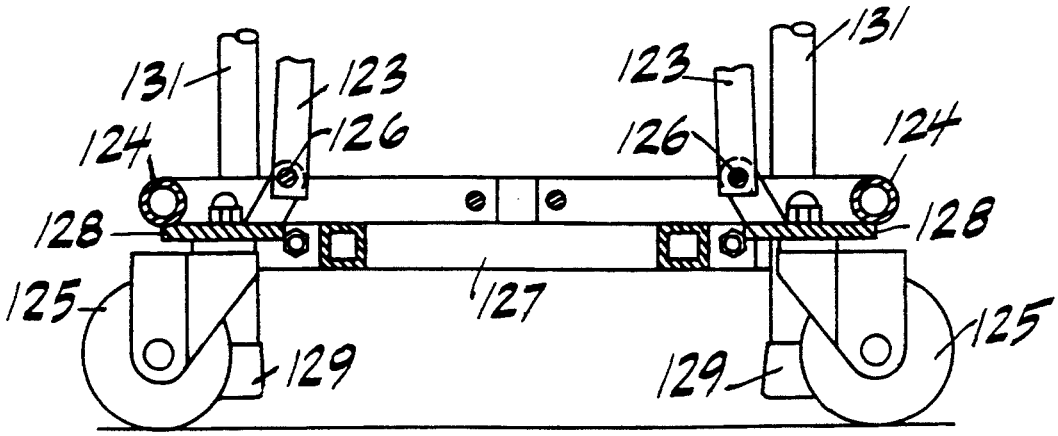
Fig. 8b (Prior Art)

In FIGS. 5A and 5B, a further feature of the present invention is illustrated by the schematic bottom view of the platform section 10. The support bracket 21 fixedly mounted to the frame 11 is shown in phantom lines at an UP position and a DOWN position corresponding to the vertical and horizontal positions of the platform section 10, respectively. The outboard legs 15 with telescoping leg sections 16 are shown in solid line when folded against the platform section 10 and in phantom line when folded down for staging use. The stabilizer bar 20 is connected between a pivot point 35 on the support bracket 21 and a pivot point 34 on the outboard leg 15 for bracing the outboard leg during staging use. When the platform section 10 is folded slightly (e.g., five degrees) past the vertical line for storage, the support bracket 21 moves to the UP position relative to the pivot bracket 13 of the platform section 10, and, when the outboard leg 15 is folded against the platform section 10, the stabilizer bar length is just sufficient to lock the platform section 10 by an over-center action. FIG. 5B shows the alignment of the pivot mounting 36 of the outboard leg 15, the pivot point 34 of the stabilizer bar 20 on the outboard leg, and the pivot point 35 of the stabilizer bar 20 on the support bracket.

The mobile folding stage unit and wheel lifting assembly in accordance with the invention has the advantages of a reduced number of parts, lower cost, and easier assembly as compared to conventional folding stage units. The support bracket is formed from a single piece of extruded metal and integrally provides the mounting to the frame, the well for holding the bearing guide, the pivot mounting for the platform section, and the abutment support member for the inner extension leg. The pivot bracket provides in a single piece the mounting for the platform section and pivot points for the support bracket, the pivot leg, and the stabilizer bar. The stabilizer bar braces the outboard legs and locks the platform sections in the upright positions. A very simple and inexpensive construction for the bearing guide and clip-on guide elements is also provided.

Although the invention has been described with reference to certain preferred embodiments, it will be appreciated that many variations and modifications may be made consistent with the broad principles of the invention. It is intended that all such embodiments, variations and modifications be included within the scope of the invention, as defined in the following claims.

I claim:

1. A mobile folding stage unit comprising:

a pair of platform sections having inner ends thereof pivotably mounted in side-by-side relation to a frame for pivotally folding the platform sections to vertical positions for storage and opening the platform sections to horizontal positions for staging use;

two sets of roller wheels, wherein each set comprises a pair of roller wheels fixedly mounted to a lower part of the frame on a respective side of the frame to which a corresponding one of the platform sections is mounted;

two sets of pivot brackets, wherein each set comprises a pair of pivot brackets fixedly mounted to a bottom surface at the inner end of a respective one of the platform sections adjacent respective ones of a corresponding set of roller wheels;

two sets of support brackets, wherein each set comprises a pair of support brackets fixedly mounted to the frame adjacent respective ones of a corresponding set of roller wheels, and wherein the respective pivot brackets of the platform sections are pivotably mounted to the corresponding support brackets of the frame;

two sets of pivot legs, wherein each set comprises a pair of pivot legs each of which has an upper end pivotably mounted to an eccentric position on a corresponding one of the pivot brackets and an intermediate length between upper and lower ends thereof; and two sets of bearing guides, wherein each set comprises a pair of bearing guides each of which is pivotably mounted to a respective support bracket adjacent a corresponding one of the roller wheels and guides a corresponding one of the pivot legs in up and down movement, wherein each said pivot leg has a selected length such that when the corresponding platform section is pivoted to the vertical position for storage, the upper end of the pivot leg is lifted by its eccentric position on the corresponding pivot bracket so that the lower end of the pivot leg is lifted above the contact point of the corresponding wheel with the ground, and when the corresponding platform section is pivoted to the horizontal position for staging use, the upper end of the pivot leg is lowered by its eccentric position on the corresponding pivot bracket so that the lower end of the pivot leg is lowered below the corresponding wheel so as to make contact with the ground.

2. A mobile folding stage unit according to claim 1, wherein each platform section has a pair of fold-down outboard legs pivotably mounted in respective positions at an outer end of the platform section, for supporting the outer end of the platform section during staging use.

3. A mobile folding stage unit according to claim 1, wherein each said pivot leg has a rectangular cross-section, and each said bearing guide has a rectangular center bore for receiving the corresponding pivot leg therein.

4. A mobile folding stage unit according to claim 3, wherein said bearing guide is defined by four inner walls each having a given length between upper and lower edges thereof, and includes four plastic guide elements attached to respective ones of the inner walls, each plastic guide element having a smooth inner surface for making contact with the pivot leg slidably moved through the center bore of the bearing guide, an outer surface which is placed in contact against a corresponding inner wall, and a pair of retainer elements spaced apart by said given length for clipping onto the upper and lower edges of the corresponding inner wall.

5. A mobile folding stage unit according to claim 1, wherein each said bearing guide is pivotably mounted in a well of the corresponding support bracket fixedly mounted to the frame of the mobile folding stage unit.

6. A mobile folding stage unit according to claim 1 further comprising two sets of inner extension legs, wherein each set comprises a pair of inner extension legs each having one end pivotably mounted to a respective pivot bracket such that the inner extension legs can be pivoted downward during staging use for supporting the corresponding platform section at a selected extension height.

7. A mobile folding stage unit according to claim 6, wherein each platform section has a pair of fold-down outboard legs pivotably mounted in respective positions at an outer end of the platform section, and each outboard leg has a telescoping leg section therein for supporting the corresponding platform section at a selected extension height.

8. A mobile folding stage unit according to claim 6, wherein each said support bracket further has a support member defined by an inner abutment wall and a pair of rounded abutment elements spaced apart from each other and from the inner abutment wall for making three-sided contact with a corresponding inner extension leg when pivoted downward during staging use.

9. A mobile folding stage unit according to claim 8, wherein said support bracket is formed of extruded metal and has said support member integrally formed therewith.

10. A mobile folding stage unit according to claim 2 further comprising two sets of stabilizer bars, wherein each set comprises a pair of stabilizer bars each of which has a given length with one end pivotably connected to a pivot point on the support bracket and its other end pivotably connected to a pivot point on a corresponding one of the outboard legs for bracing the outboard legs during staging use.

11. A mobile folding stage unit according to claim 10, wherein the length of the stabilizer bar, the pivot point on the outboard leg, and the pivot point on the support bracket are selected such that the stabilizer bar has an over-center locking function for locking the corresponding platform section in the vertical position for storage.

12. A wheel lifting assembly for a mobile unit having a frame, at least one pivoting section having an inner end thereof pivotably mounted to the frame for pivoting the pivoting section between upward and downward positions, and at least one wheel mounted to a lower part of the frame adjacent the inner end of the pivoting section, said wheel lifting assembly comprising:

a pivot bracket mounted to a bottom surface at the inner end of the pivoting section adjacent the wheel;

a support bracket mounted to the frame adjacent the wheel to which the pivot bracket is pivotably mounted;

a pivot leg which has an upper end pivotably mounted to an eccentric position on the pivot bracket and an intermediate length between upper and lower ends thereof; and a bearing guide which is pivotably mounted to the support bracket adjacent the wheel and guides the pivot leg in up and down movement, wherein the pivot leg has a selected length such that when the pivoting section is pivoted to the upward position, the upper end of the pivot leg is lifted by its eccentric position on the pivot bracket so that the lower end of the pivot leg is lifted above the contact point of the wheel with the ground, and when the pivoting section is pivoted to the downward position, the upper end of the pivot leg is lowered by its eccentric position on the pivot bracket so that the lower end of the pivot leg is lowered below the wheel so as to make contact with the ground.

13. A wheel lifting assembly according to claim 12, wherein said support bracket includes a well in which the bearing guide is pivotably mounted.

14. A wheel lifting assembly according to claim 12, wherein a swing-down extension leg has one end pivotably mounted to the pivot bracket, and said support bracket includes a support member defined by an inner abutment wall and a pair of rounded abutment elements spaced apart from each other and from the inner abutment wall for making three-sided contact with the extension leg when swung down during use.

15. A wheel lifting assembly according to claim 14, wherein said support bracket is formed of extruded metal and has said support member integrally formed therewith.

* * * * *